US008061148B2

(12) United States Patent
Ethier et al.

(10) Patent No.: US 8,061,148 B2
(45) Date of Patent: Nov. 22, 2011

(54) PORTABLE TEMPERATURE-CONTROLLED CONTAINER

(75) Inventors: Sylvain S E Ethier, Ste-Therese (CA); Gaetan Beaupre, Terrebonne (CA); Mark Bedard, St. Lambert (CA)

(73) Assignee: SG Productions, Blainville, Quebec (CA)

( * ) Notice: Subject to any disclaimer, the term of this patent is extended or adjusted under 35 U.S.C. 154(b) by 686 days.

(21) Appl. No.: 11/915,094

(22) PCT Filed: May 19, 2006

(86) PCT No.: PCT/CA2006/000829

§ 371 (c)(1),
(2), (4) Date: Nov. 5, 2008

(87) PCT Pub. No.: WO2006/122428

PCT Pub. Date: Nov. 23, 2006

(65) Prior Publication Data

US 2009/0145138 A1 Jun. 11, 2009

Related U.S. Application Data

(60) Provisional application No. 60/682,850, filed on May 20, 2005.

(51) Int. Cl.
*F25B 21/02* (2006.01)

(52) U.S. Cl. ..... 62/3.6; 62/457.3

(58) Field of Classification Search ..... 62/3.2, 62/3.3, 3.6, 457.1, 457.3, 457.8
See application file for complete search history.

(56) References Cited

U.S. PATENT DOCUMENTS

| | | | | |
|---|---|---|---|---|
| 5,718,124 | A | 2/1998 | Senecal | |
| 2002/0162339 | A1 | 11/2002 | Harrison et al. | |
| 2003/0213814 | A1 * | 11/2003 | Phelps et al. | 222/146.6 |
| 2005/0116589 | A1 * | 6/2005 | Conroy | 312/242 |
| 2006/0213206 | A1 * | 9/2006 | Linder | 62/3.6 |

FOREIGN PATENT DOCUMENTS

| | | |
|---|---|---|
| FR | 2759744 | 8/1998 |
| GB | 2333095 | 7/1999 |
| JP | 9138047 | 5/1997 |
| JP | 10288449 | 10/1998 |

* cited by examiner

*Primary Examiner* — Melvin Jones
(74) *Attorney, Agent, or Firm* — Ladas & Parry LLP

(57) ABSTRACT

The present invention generally relates to containers and more specifically, to a portable temperature-controlled container. The temperature-controlled container is used for maintaining articles at a controlled temperature. The container includes a housing unit defining a storage chamber for receiving the articles, a cooling system mounted to the housing unit, wherein the cooling system includes a cold side assembly system in heat transfer communication with the interior of the chamber, a hot side assembly system in heat transfer communication with the outside of the storage chamber and a thermoelectric module supplied with an electrical power source.

23 Claims, 8 Drawing Sheets

PORTABLE TEMPERATURE-CONTROLLED CONTAINER

FIELD OF THE INVENTION

The present invention generally relates to containers. More specifically but not exclusively, the present invention is concerned with a temperature-controlled container that is portable.

BACKGROUND OF THE INVENTION

Temperature-controlled containers, such as, for example, wine or food coolers, are generally designed to maintain items at specific temperatures or to help preserve the freshness of food products which are stored therein.

Typically, wine coolers are designed to refrigerate bottles of wines that are not already open, in order to keep wine within a temperature range that is ideal for consumption and/or conservation. Once a bottle of wine has been opened but not emptied, such as when the wine is served by the glass, the wine bottle is usually left on a counter top and is thereby subjected to warmer surrounding ambient temperatures. The wine's temperature will become warm, which can be detrimental to its taste and enjoyment.

Alternatively, an opened wine bottle may be stored in a refrigerator or in a bucket of ice. In this case, however, it becomes difficult to efficiently control the temperature of the bottle of wine.

Wine coolers are most often designed to provide storage for bottles of wine in a generally horizontal orientation, usually in rows of supports stacked one on top of the other. This is done to minimize the vertical space and to maximize storage capacity. However, horizontal storage may favor wine spillage when a partially filled wine bottle is returned to the wine cooler.

Additionally, an opened wine bottle may necessitate more space when provided with a removable seal. It may further require a specific vertical storage orientation to be more readily accessible when, for example, the bottle simply needs to be identified, or when the bottle is corked with metering devices.

SUMMARY OF THE INVENTION

An object of the present invention is therefore to provide a temperature-controlled container that facilitates the storage of containers that are completely or partially filled. The container of the present invention is ideal for the temperature-controlled storage of food items and fluids, including wine, but may also be used to preserve other items within a selected temperature range.

In accordance with an aspect of the present invention there is provided a wine bottle temperature control container comprising: a housing unit defining a storage chamber configured to receive a plurality of bottles in an upright position; a cooling system mounted to the housing unit, the cooling system comprising a cold side assembly system in heat transfer communication with the inside of the chamber, and a hot side assembly system in heat transfer communication with the ambient environment of the chamber; and a temperature modulator linked to the cooling system for modulating the temperature within the storage chamber.

In accordance with another aspect of the present invention, there is provided a temperature control container comprising: a housing unit defining a storage chamber for receiving articles therein; a cooling system mounted to the housing unit, the cooling system comprising a cold side assembly system in heat transfer communication with the inside of the chamber, and a hot side assembly system in heat transfer communication with the outside of the storage chamber; and a drainage system in communication with the cooling system so as to receive condensed liquid therefrom, the drainage system being in communication with ambient environment, wherein at least a portion of the received condensed liquid is allowed to evaporate into the ambient environment.

In an embodiment, the temperature modulator comprises a first face for generating a predetermined temperature and a second face for generating a temperature different from the predetermined temperature; the first face being mounted to the cold side assembly system and the second face being mounted to the hot side assembly system. In an embodiment, the temperature modulator comprises thermoelectric modules.

In an embodiment, cold side assembly comprises a heat sink and a fan. In an embodiment, the temperature modulator comprises thermoelectric modules, the heat sink being mounted to the thermoelectric modules. In an embodiment, the fan provides for air circulation from the chamber to the heat sink.

In an embodiment, the cold side assembly comprises a heat sink and a fan. In an embodiment, the temperature modulator comprises thermoelectric modules, the heat sink being mounted to the thermoelectric modules. In an embodiment, the fan provides for air circulation from ambient environment to the heat sink.

In an embodiment, the cold side assembly and the hot side assembly comprise a cold side heat sink and a hot side heat sink, respectively. In an embodiment, the cold side heat sink and a hot side heat sink are mounted together. In an embodiment, the temperature modulator comprises thermoelectric modules, and each cold side heat sink and a hot side heat sink are mounted to respective thermoelectric modules. In an embodiment, the thermoelectric modules are mounted between the cold side heat sink and the hot side heat sink.

In an embodiment, the temperature modulator comprises a controller and temperature sensors linked to the controller for signaling data thereto. In an embodiment, the temperature modulator comprises a first temperature sensor for monitoring the temperature within the chamber. In an embodiment, the temperature modulator comprises thermoelectric modules and each cold side heat sink and a hot side heat sink is mounted to respective thermoelectric modules, and wherein the temperature modulator comprising a second temperature sensor for sensing the temperature of the thermoelectric modules. In an embodiment, the controller is linked to a control board.

In an embodiment, the housing unit comprises a liquid drainage system in communication with the control system. In an embodiment, the liquid drainage system is in communication with the ambient environment. In an embodiment, the liquid drainage system drains liquid away from the chamber. In an embodiment, the drainage system comprises a liquid receiving unit for receiving condensed liquid from the control system. In an embodiment, the liquid receiving unit comprises a drip pan. In an embodiment, the liquid receiving unit is in communication with the ambient environment. In an embodiment, the liquid receiving unit comprises a wicking medium. In an embodiment, the wicking medium is in communication with the ambient environment. In an embodiment, the wicking medium is so configured as to absorb condensed liquid from the cooling system so as to provide for at least a portion of the condensed liquid to evaporate into the ambient environment.

In an embodiment, the housing comprises a backing wall having a front side and a back side, the front side defining a wall of the chamber, the back side being in communication the ambient environment, and the cooling system mounted to the backing wall, such that the cold side assembly is mounted to the font side and the hot side assembly is mounted to the back side. In an embodiment, the housing further comprises a floor wall that houses a liquid drainage system, the liquid drainage system being in fluid communication with the control system so as to receive condensed liquid therefrom. In an embodiment, the drainage system is in communication with the ambient environment via the back side of the backing wall so as to provide for at least a portion of the received condensed liquid to evaporate into the ambient environment.

In an embodiment, the housing comprises a translucent cover to allow viewing of articles therein. In an embodiment, the housing comprises internal padded walls defining the chamber.

In an embodiment, the temperature control container further comprising a temperature modulator linked to the cooling system for modulating the temperature within the storage chamber. In an embodiment, the temperature modulator comprises a first face for generating a predetermined temperature and a second face for generating a temperature different from the predetermined temperature, the first face being mounted to the cold side assembly system and the second face being mounted to the hot side assembly system. In an embodiment, the temperature modulator comprises thermoelectric modules.

A further object of the present invention is to provide a temperature-controlled container that is portable and equipped with a cooling system that generates minimal noise and vibrations.

In an embodiment, there is provided a temperature-controlled container for maintaining articles at a controlled temperature, the container comprising: a housing unit including walls and a door defining a storage chamber for receiving the articles;

a) a cooling system mounted to the housing unit and including:

i. a cold side assembly system in heat transfer communication with the interior of the chamber;

ii. a hot side assembly system in heat transfer communication with the outside of the chamber;

iii. a thermoelectric module having a first face for generating a predetermined temperature and a second face for generating a temperature different from the predetermined temperature, the first face being mounted to the cold side assembly system and the second face being mounted to the hot side assembly system; and b) a power source for supplying power to the thermoelectric module.

The terms "temperature control container" and "temperature-controlled container" are interchangeable.

The foregoing and other objects, advantages and features of the present invention will become more apparent upon reading of the following non-restrictive description of illustrative embodiments thereof, given by way of example only with reference to the accompanying drawings.

DETAILED DESCRIPTION

The non-restrictive illustrative embodiment of a portable temperature-controlled container 30 according to the present invention will now be described with reference to FIGS. 1-10.

Figure 1:
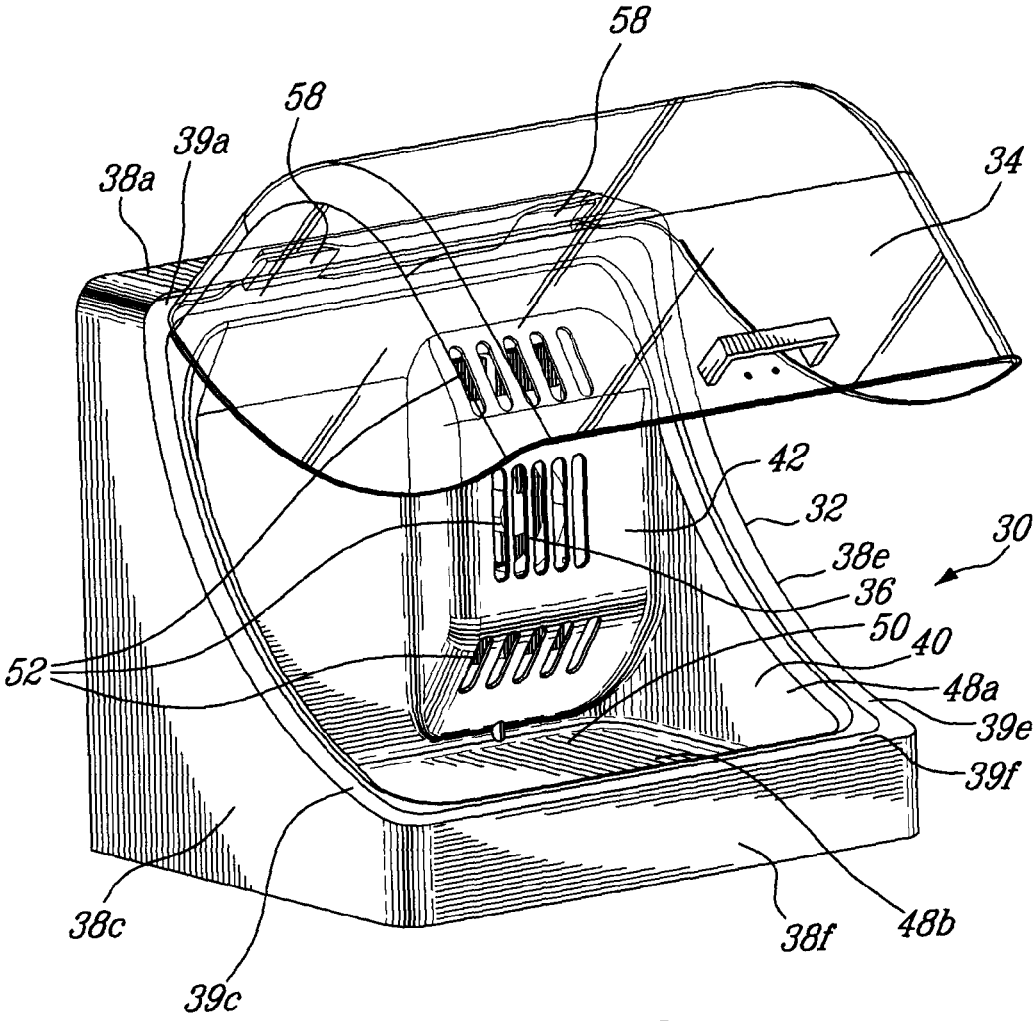
FIG. 1 is a front perspective view of a portable temperature-controlled container according to an illustrative embodiment of the present invention.

Referring to FIG. 1, the portable temperature control or temperature-controlled container 30 includes a housing unit 32, a door 34 and a cooling system 36. The housing unit 32 is a generally rigid frame assembly including walls 38*a*, 38*b*, 38*c*, 38*d*, 38*e*, and 38*f* defining a storage chamber 40, front and back cover members 42, 44 and a removable drip pan 46 (better illustrated in FIG. 9).

In the illustrative embodiment of FIG. 1, four of the walls 38*a*, 38*c*, 38*e* and 38*f* of the temperature-controlled container 30 are provided with corresponding shoulders 39*a*, 39*c*, 39*e* and 39*f* configured and sized so as to sealingly receive the door 34, as will be further explained below. Also, as shown in more detail in FIG. 8, one of the walls, 38*b*, is provided with an aperture 47 opening to the removable drip pan 46 and in the general proximity of the cooling system 36. The aperture 47 is so configured and sized as to collect condensed liquid generated by the use of the cooling system 36, as will further be explained below.

The surfaces of the walls 38*a*, 38*b*, 38*c*, 38*d*, 38*e*, and 38*f* facing the chamber 40 are generally provided with padding structures 48*a*, 48*b* (shown in FIG. 1) and the outer surface of the walls 38*a*, 38*b*, 38*c*, 38*d*, 38*e*, and 38*f* may also be covered by insulating and/or decorative materials, such as wood, stainless steel or polymeric materials.

The padding structures 48*a*, 48*b* are generally manufactured from molded polystyrene or other insulating materials. The padding structure 48*b* is generally configured and sized so as to receive articles such as, for example, wine bottles which may be positioned vertically in the storage chamber 40. The padding structure 48*b* below the cooling system 36 includes a drain hole 50 (shown in FIG. 1) in alignment with the aperture 47 (shown in FIG. 8) and the drip pan 46 (shown in FIG. 9) and alternatively, a sloped surface (not shown) directing condensed liquid toward the drain hole 50.

Referring again to FIG. 1, the front cover member 42 includes slits 52 and extends from the padding structure 48*a* to separate the cooling system 36 from the chamber 40. The shape of the front cover member 42 and the number of slits 52 are generally designed to provide optimized refrigeration within the chamber when the cooling system 36 is in operation. At the same time, the front cover member 42 provides protection to users of the portable temperature-controlled container 30 and minimizes chances of contact between the cooling system 36 and articles positioned in the storage chamber 40.

Figure 9:
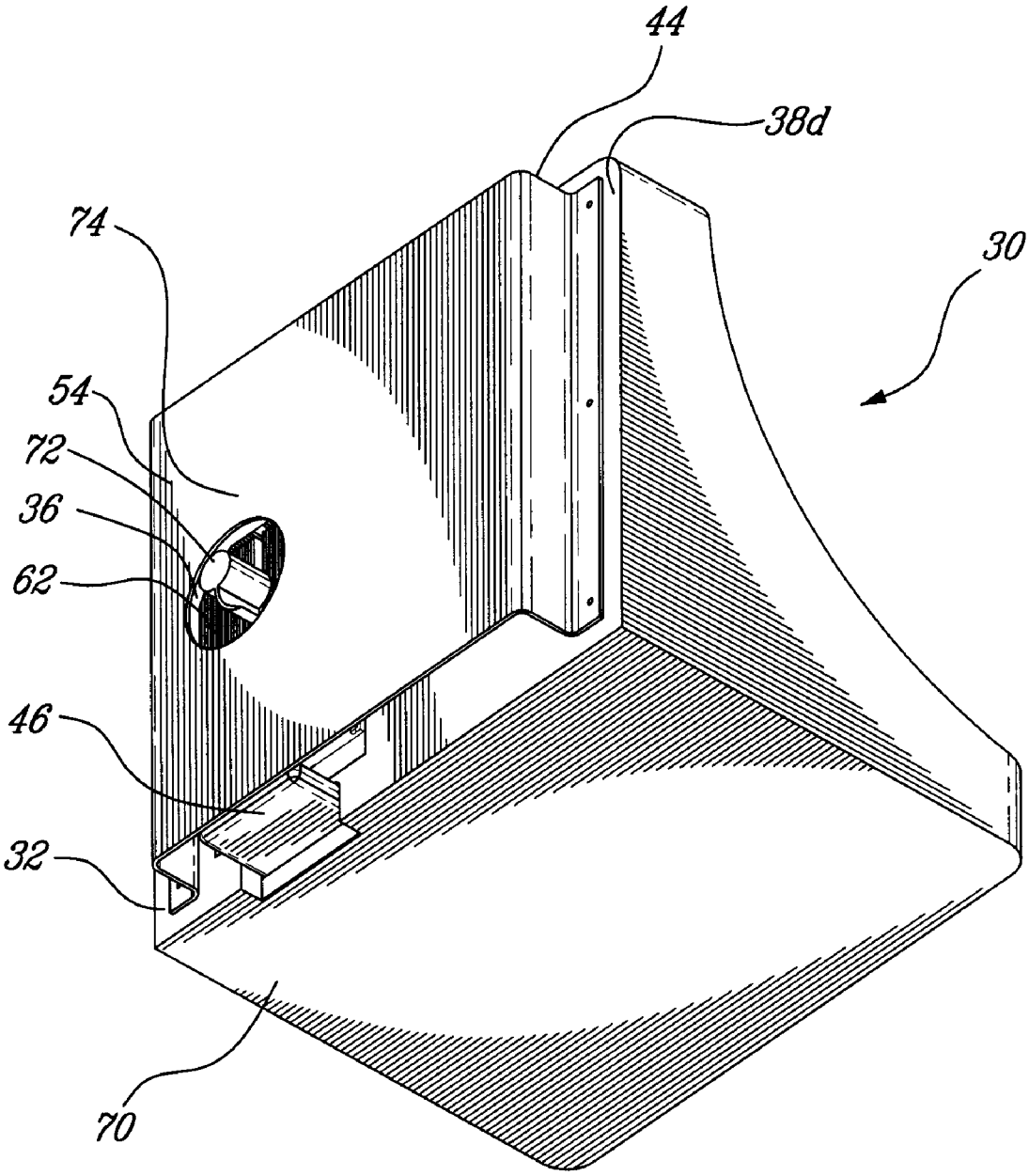
FIG. 9 is a partial rear perspective view of the portable temperature-controlled container of FIG. 1 illustrating the temperature control elements.

The back cover member 44, shown in greater detail in FIG. 9, includes an aperture 54 and extends from one of the walls, 38*d*, to separate the cooling system 36 from the surrounding environment of the portable temperature-controlled container 30. The aperture 54 is configured and sized so as to optimize the intake of air drawn to the cooling system 36, as will be further explained below. The shape of the back cover member 44 is generally designed to protect the surrounding environment of the portable temperature-controlled container 30 when the cooling system 36 is in operation. Optionally, a lid 56 is removably positioned over the back cover member 44 to provide uniformity with the walls 38*a*, 38*b*, 38*c*, 38*d*, 38*e*, and 38*f*, as illustrated in FIGS. 3 to 7.

Figure 8:
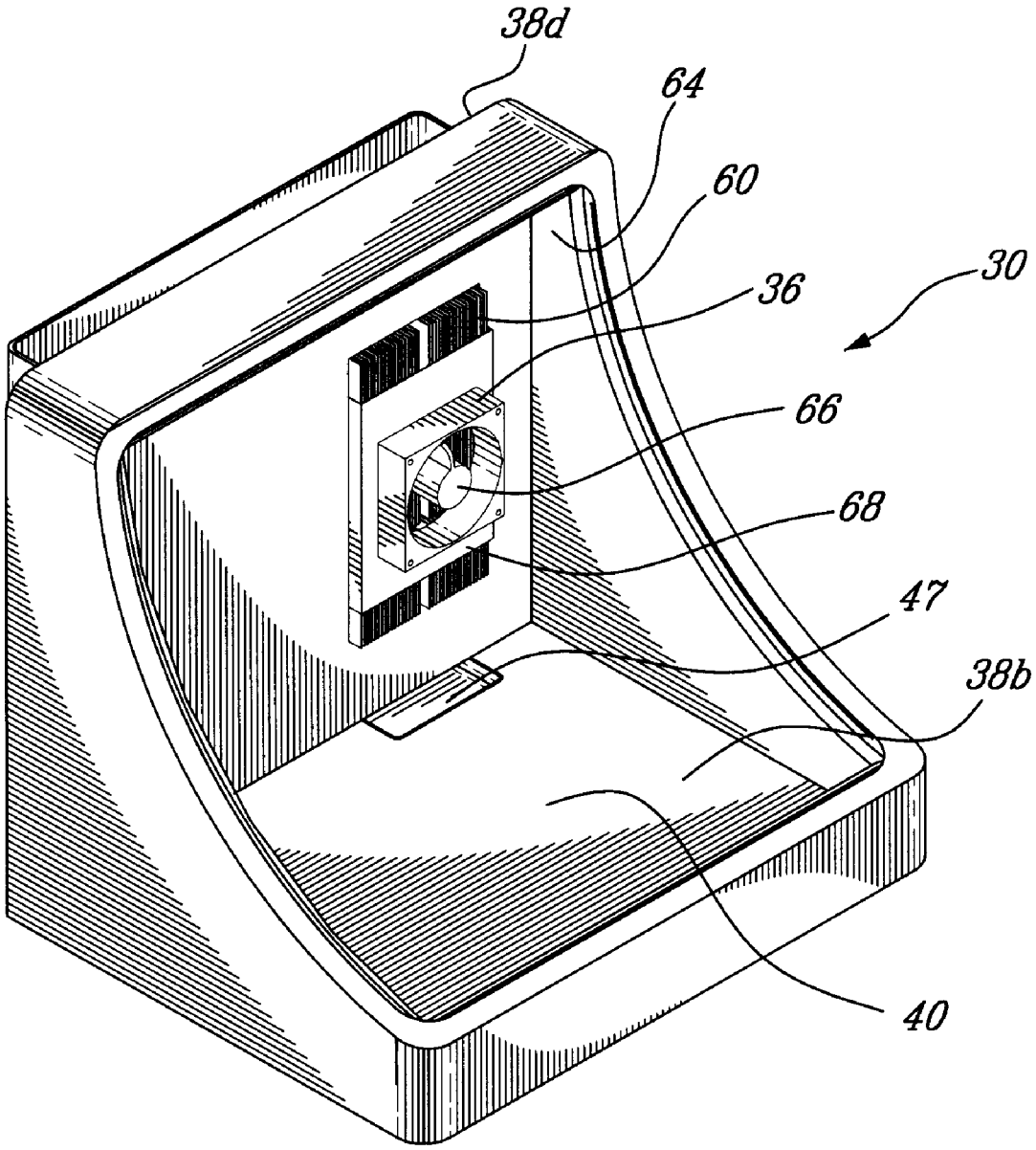
FIG. 8 is a partial front perspective view of the portable temperature-controlled container of FIG. 1 illustrating the temperature control elements.

Referring again to FIG. 9, the drip pan 46 is generally contained in and removable from the housing unit 32, and is configured and sized so as to receive liquid condensed and drained away from the storage chamber 40 (FIGS. 1 and 8).

Moreover, the drip pan 46 is designed to optionally receive and hold a wicking medium (not shown) such as, for example, a sponge, in order to attract the condensed liquid toward the drip pan 46 and direct it outside of the temperature-controlled container 30, which has the effect of helping a portion of the condensed liquid to evaporate to the surrounding area while the cooling system 36 is in operation, as will be further explained below. The wicking medium may further act as a sealing member such as a gasket to keep refrigerated air from flowing out of the storage chamber 40.

Figure 2:
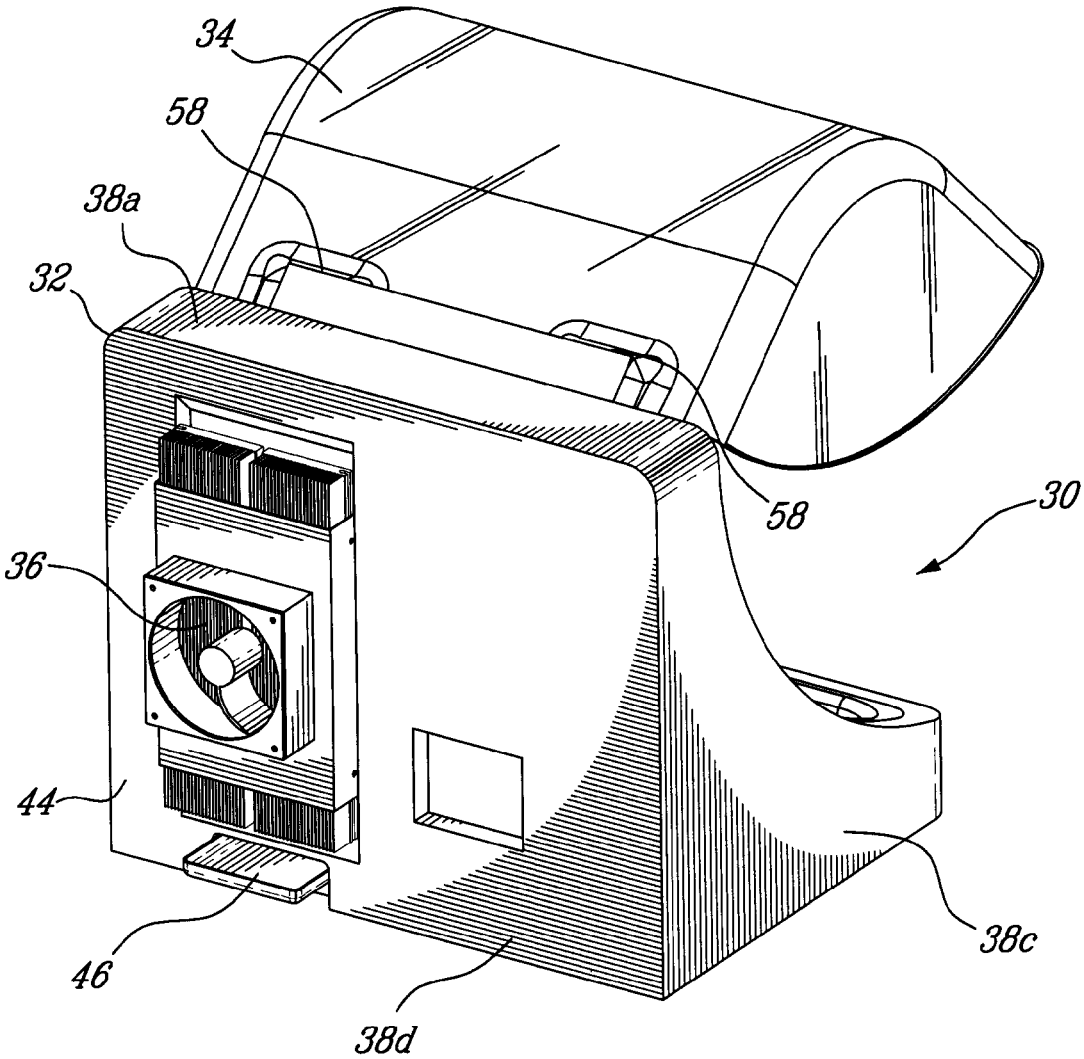
FIG. 2 is a rear perspective view of the portable temperature-controlled container of FIG. 1.
Figure 3:
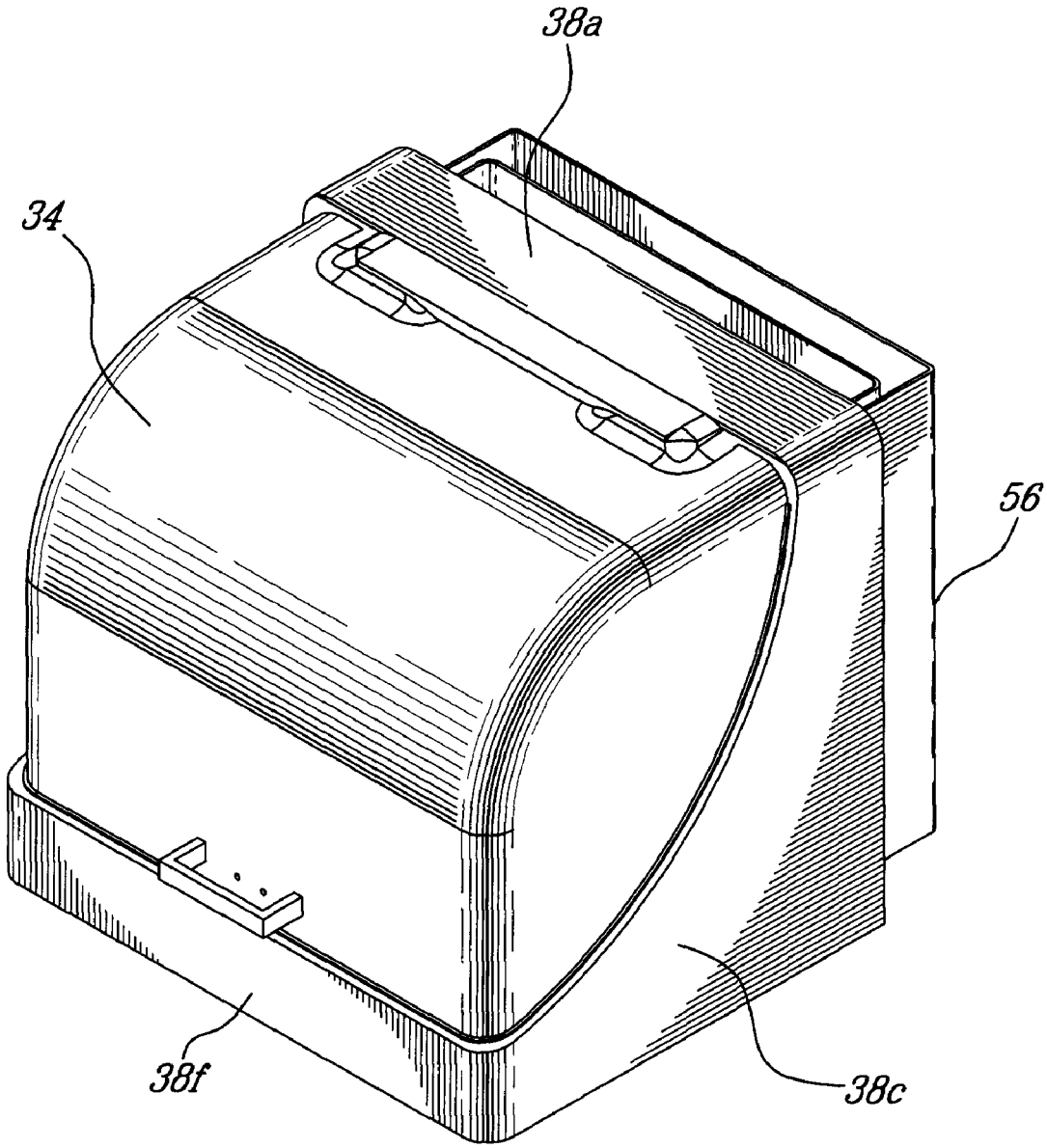
FIG. 3 is a front perspective view of the portable temperature-controlled container of FIG. 1 shown with its door closed.
Figure 4:
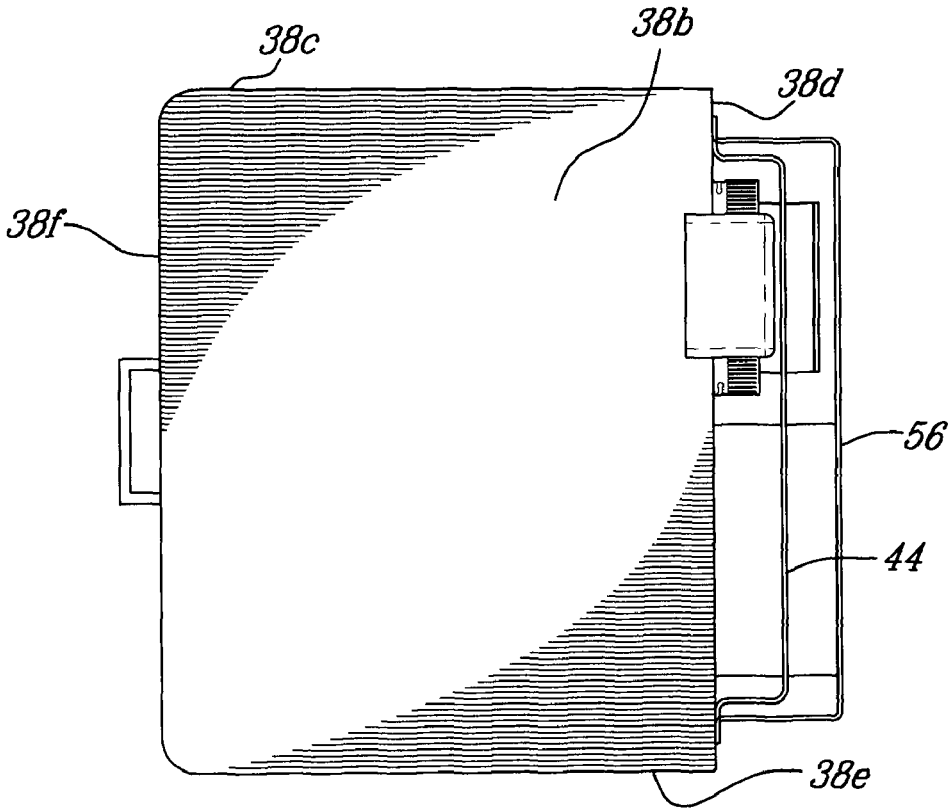
FIG. 4 is a bottom view of the portable temperature-controlled container of FIG. 3.
Figure 5:
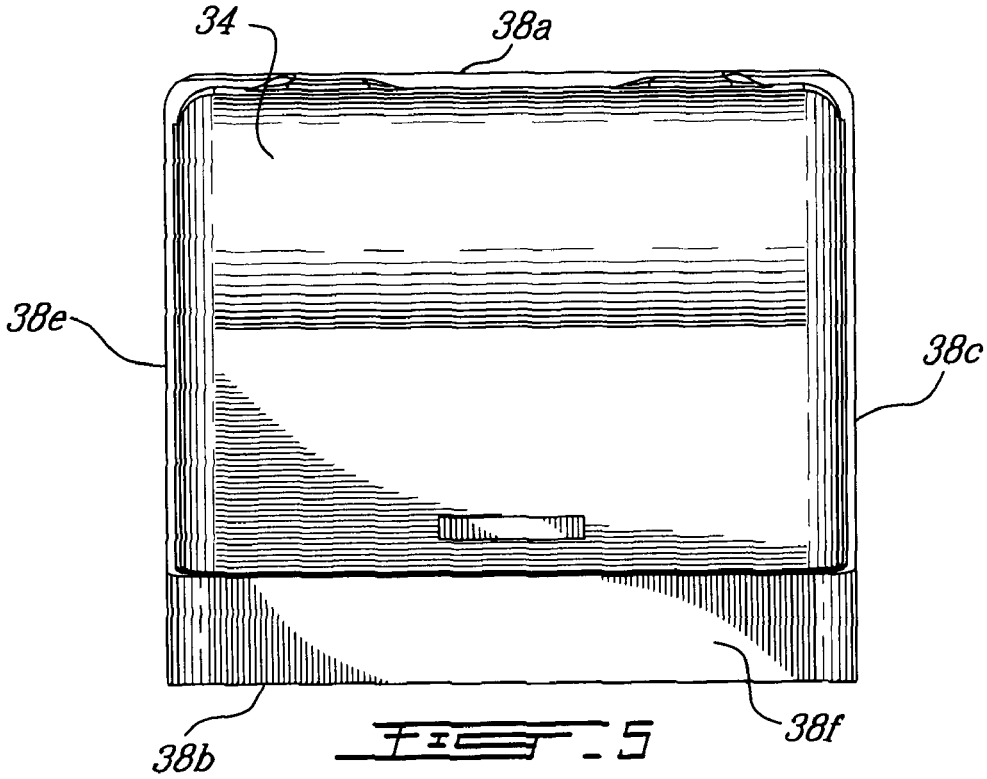
FIG. 5 is a front elevation view of the portable temperature-controlled container of FIG. 3.
Figure 6:
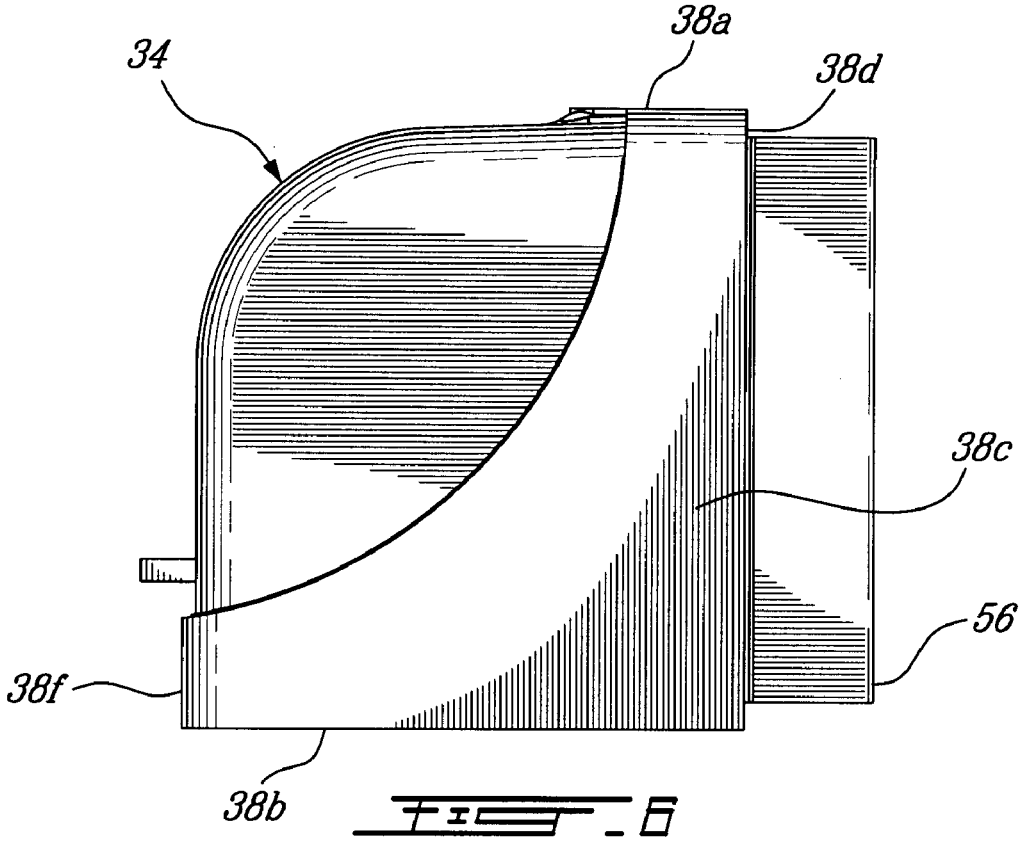
FIG. 6 is a side elevation view of the portable temperature-controlled container of FIG. 3.
Figure 7:
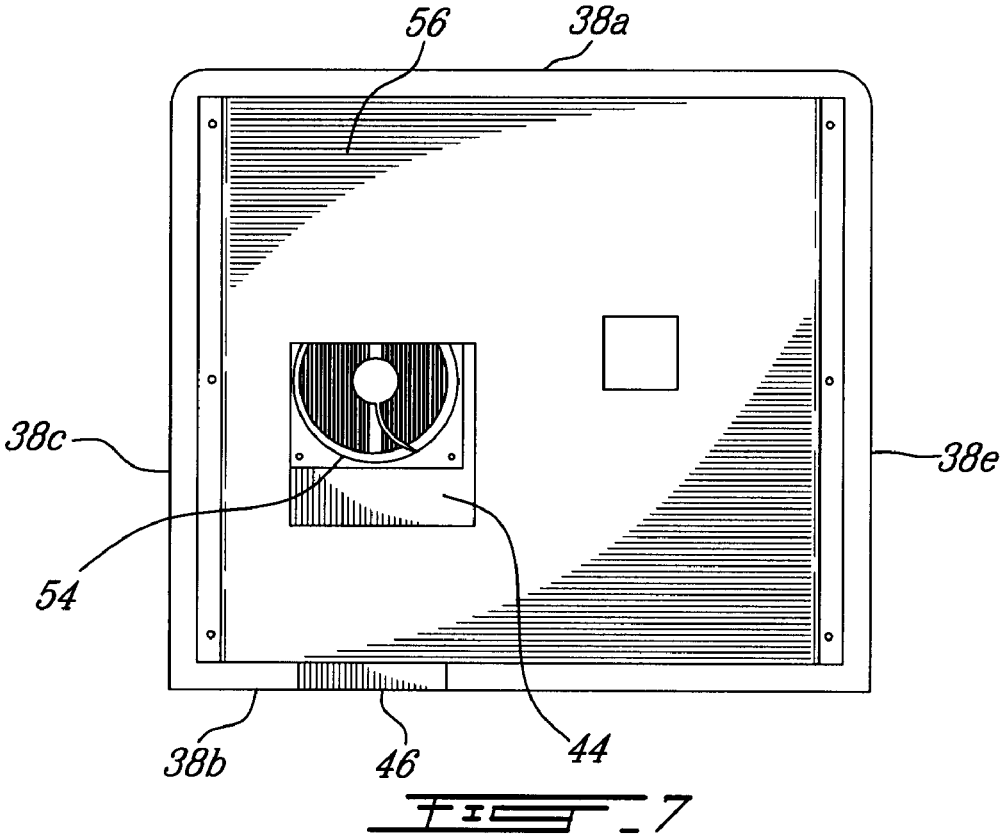
FIG. 7 is a rear elevation view of the portable temperature-controlled container of FIG. 3.

As illustrated in FIGS. 1 and 2, the door 34 is mounted to the housing unit 32 through hinges 58 on one of the walls 38*a* such as to pivot between an open and a closed position. When in a closed position, the door sealingly rests on shoulders 39*a*, 39*c*, 39*e* and 39*f* of the walls 38*a*, 38*c*, 38*e* and 38*f*. The door 34 may allow the visibility of articles such as wine bottles when stored in the storage chamber 40, and may be made from a plurality of materials including, for example, acrylic or glass.

In one embodiment, as shown in FIGS. 8 and 9, the cooling system 36 is generally a thermoelectric cooling system mounted to and through one of the walls 38*d*. As illustrated in FIGS. 8 and 9, respectively, the cooling system 36 includes a cold side assembly system 60, a hot side assembly system 62 and a series of thermoelectric modules (not shown).

Referring now to FIG. 8, the cold side assembly system 60 includes a heat sink 64 and a fan 66, and generally extends toward the storage chamber 40. The heat sink 64 is mounted to the thermoelectric modules (not shown), generally via a thermally conductive paste used to increase the contact between the two. The heat sink 64 may be made from aluminum or other thermally conductive materials.

Referring still to FIG. 8, the fan 66 is mounted to the cooling system 36 via a bracket 68 and is configured and sized so as to allow the circulation of air from the chamber 40 and toward the heat sink 64, resulting in cooler air inside the portable temperature-controlled container 30. In one embodiment, the fan 66 is a 90 mm or 120 mm cartridge fan, but other fans would also be suitable to achieve the desired result.

Referring now to FIG. 9, the hot side assembly system 62 includes a heat sink 70 and a fan 72, and generally extends away from the portable temperature-controlled container 30. The heat sink 70 is mounted to the thermoelectric modules (not shown), generally via a thermally conductive paste used to increase the contact between the two. The heat sink 70 may be made from aluminum or other thermally conductive materials.

Referring still to FIG. 9, the fan 72 is fan mounted to the cooling system 36 via a bracket 74 and is configured and sized so as to circulate ambient air from the surrounding area of the portable temperature-controlled container 30 toward the heat sink 70 for generating heat transfer and discharging the heat into the room. In one embodiment, the fan 72 is a 90 mm or 120 mm cartridge fan, but other fans would also be suitable to achieve the desired result.

Still with reference to FIG. 9, air is generally drawn by the fan 72 from the aperture 54 or from between the back cover member 44 and the wall 38*d*. When a wicking medium (not shown) containing condensed liquid is positioned in the drip pan 46, the air drawn by the fan 72 may help to evaporate a portion of the condensed liquid as it circulates in the vicinity of the drip pan 46.

In one embodiment of the present invention, the thermoelectric modules are connected in series and powered by a 24-volt direct current power supply. The thermoelectric modules work as a heat pump, in accordance with the generally known Peltier effect. When the thermoelectric modules are supplied with electrical power, the thermoelectric modules develop a first cold face in thermal contact with the cold side assembly system 60 (FIG. 8) and a second hot face in thermal contact with the hot side assembly system 62.

The two heat sinks, 64 (FIG. 8) and 70 (FIG. 9), are mounted together with the thermoelectric modules sandwiched between the two, via a series of fastening means such as bolts tightened at a specific torque. For example, nylon washers may be used to prevent thermal bridging between the heat sinks 64 and 70, and spring washers may further be used to accept expansion of the heat sinks 64, 70 generally fabricated from thermal conductive materials such as aluminum.

Figure 10:
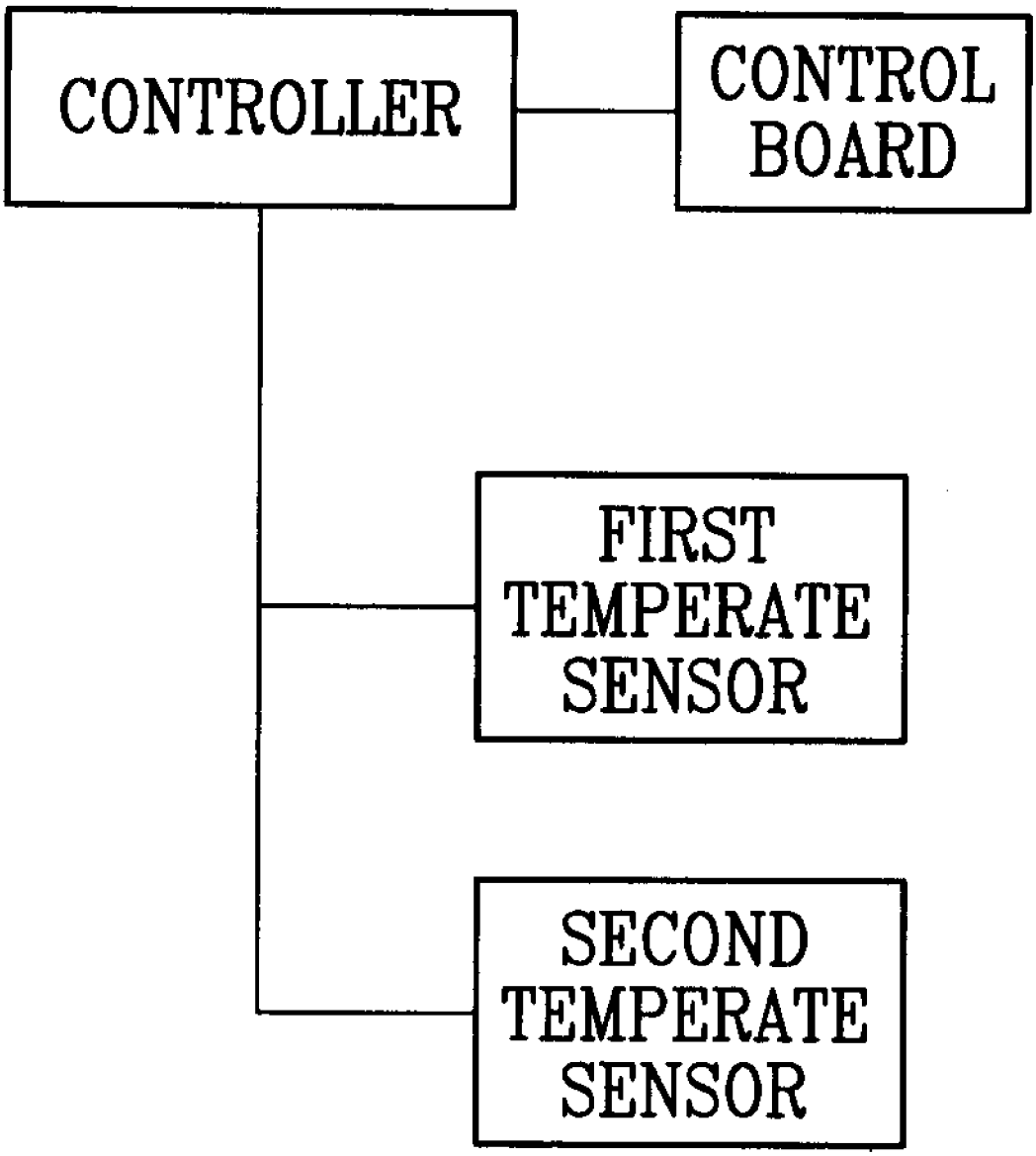
FIG. 10 is a schematic view of the controller and temperature sensors of the present invention in accordance with an illustrative embodiment thereof.

With reference to FIG. 10, the cooling system 36 may further include a controller and temperature sensors. As an example, 115 volts may feed the controller by entering into a metal electrical enclosure through a 3-braid wire. A strain relief device is installed on the 3-braid wire and snapped into the metal enclosure. A power cord is attached, for example, to a 150-watt switching power supply. The output power is generally around 22.5 VDC. The output is connected to a control board.

The control board is mounted to the electrical enclosure. There are three outputs from the control board, each fused generally at around 3.2 amperes. Generally, two of the outputs are used for the thermoelectric modules and the third output is used for the two fans 66 and 72.

A first temperature sensor may be used to monitor the cooler temperature, generally corresponding to the value of the temperature in the storage chamber 40, and a second temperature sensor may also be used as an "over" temperature sensor. The over temperature sensor is programmed to cut power to the thermoelectric modules if the temperature in proximity of the heat sink 70 (FIG. 9) and the hot face of the thermoelectric modules is greater than a select temperature, for example, 60 degrees Celsius.

The portable temperature-controlled container 30 may be used as follows, as shown in FIG. 10. First, the cooling system 36 is put in operation as described above and articles such as, for example, wine bottles may be positioned in the storage chamber 40 after opening the door 34. The wine bottles are positioned generally vertically oriented along their longitudinal extension, such that their bottom surface lies on the padding structure 48*b* or directly on the wall 38*b*.

The door 34 which is generally in sealing contact with shoulders 39*a*, 39*c*, 39*e* and 39*f* of the walls 38*a*, 38*c*, 38*e* and 38*f*, may be closed and the cooling system 36 is then ready to be operated or pursue its temperature-controlling operation. Once the bottles of wines are refrigerated to the desired temperature, or simply when needed, the bottles may be removed from the storage chamber 40 by opening the door 34 while the cooling system 36 is still operating.

In an non-illustrated embodiment, the wall 38*f* may include a screen for indicating the temperature within the storage chamber.

A cooling sequence of the portable temperature-controlled container 30 will now be given as an example. When the cooling system 36 is in operation, the first temperature sensor senses that the air leaving the thermoelectric modules is greater than a desired predetermined set point of, for example, 14 degrees Celsius. A signal is thereby received by the controller to apply full power to the thermoelectric modules.

As the temperature falls by the operation of the cooling system 36 and approaches the predetermined set point, the control board reduces the power to the thermoelectric modules, for example, by pulse width modulation. The closer the temperature approaches the predetermined set point, the higher the pulsing, resulting in less cooling available in the storage chamber 40.

Using this method, the thermoelectric modules are most of the time powered to some degree as opposed to being cycled on and off. This method generally allows a more precise control as well as minimizes thermal shock of the thermoelectric modules.

A means for defrosting the cooling system 36 is achieved as follows. For example, every 12 hours, the power supply to the thermoelectric modules is cut, resulting in heat flowing back through the ambient and hot air flowing back through the portable temperature-controlled container 30 by conduction. In this manner, any accumulated ice is defrosted. This "off period" may last, for example, for 6 minutes, for example. Upon completion of the defrost cycle, the cooling system 36 returns to its normal operation.

With the embodiment of the invention described above, it is possible to maintain the temperature within the chamber 40 constant within a range of approximately 7 degrees Celsius to approximately 18 degrees Celsius.

One skilled in the art will easily understand that although the present invention has been specifically described for the vertical storage of wine bottles, other articles needing to be preserved at a given temperature once unpacked or opened may also be stored in the portable temperature-controlled container 30. Accordingly, the shape and configuration of the housing unit 32 and of the door 34 may vary to accommodate various articles positioned in the storage chamber 40 (FIG. 1).

A person skilled in the art will also understand that the assembly of the door 34 to the housing unit 32 may also vary. For instance, the door 34 may be simply positioned or slidably mounted to the housing unit 32.

Additionally, a person skilled in the art will understand that the temperature-controlled container may be used with other types of cooling systems. For example, conventional refrigeration systems including compressors, condenser, evaporator and refrigerant may be used to replace the thermoelectric modules.

Finally, a person skilled in the art will understand that although the cooling system 36 has been described above with a cold side assembly system 60 extending in the interior of the chamber, the cooling system 36 may be reversibly mounted with respect to the portable temperature-controlled container 30 such as to operate in a reverse mode. For example, the hot side assembly system 62 could be positioned so as to extend in the interior of the chamber 40 to warm or preserve various items positioned therein within a selected temperature range.

It should be understood that the controller, sensors, and thermoelectric modules define a temperature modulator for modulating the temperature of the chamber.

Although the present invention has been described hereinabove by way of embodiments thereof, it can be modified, without departing from the spirit and nature of the subject invention.

What is claimed is:

1. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said temperature modulator comprises a first face for generating a predetermined temperature and a second face for generating a temperature different from said predetermined temperature; said first face being mounted to said cold side assembly system and said second face being mounted to said hot side assembly system.

2. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said cold side assembly comprises a heat sink and a fan, said temperature modulator comprising thermoelectric modules, said heat sink being mounted to said thermoelectric modules, said fan providing for air circulation from said chamber to said heat sink.

3. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said cold side assembly comprises a heat sink and a fan, wherein said temperature modulator comprises thermoelectric modules, said heat sink being mounted to said thermoelectric modules, wherein said fan provides for air circulation from ambient environment to said heat sink.

4. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said cold side assembly and said hot side assembly comprise a cold side heat sink and a hot side heat sink, respectively.

5. A wine bottle temperature control container according to claim 4, wherein said cold side heat sink and said hot side heat sink are mounted together.

6. A wine bottle temperature control container according to claim 5, wherein said temperature modulator comprises thermoelectric modules, and each said cold side heat sink and said hot side heat sink are mounted to respective said thermoelectric modules.

7. A wine bottle temperature control container according to claim 6, wherein said thermoelectric modules are mounted between said cold side heat sink and said hot side heat sink.

8. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said temperature modulator comprises a controller and temperature sensors linked to said controller for signaling data thereto.

9. A wine bottle temperature control container according to claim 8, wherein said temperature modulator comprises a first temperature sensor for monitoring the temperature within said chamber.

10. A wine bottle temperature control container according to claim 8, wherein said temperature modulator comprises thermoelectric modules and each said cold side heat sink and said hot side heat sink is mounted to respective said thermoelectric modules, and wherein said temperature modulator comprises a second temperature sensor for sensing the temperature of said thermoelectric modules.

11. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said housing unit comprises a liquid drainage system in communication with said control system.

12. A wine bottle temperature control container according to claim 11, wherein said liquid drainage system is in communication with the ambient environment.

13. A wine bottle temperature control container according to claim 11, wherein said liquid drainage system drains liquid away from said chamber.

14. A wine bottle temperature control container according to claim 11, wherein said drainage system comprises a liquid receiving unit for receiving condensed liquid from said control system.

15. A wine bottle temperature control container according to claim 14, wherein said liquid receiving unit is in communication with the ambient environment.

16. A wine bottle temperature control container according to claim 14, wherein said liquid receiving unit comprises a wicking medium.

17. A wine bottle temperature control container according to claim 15, wherein said wicking medium is in communication with the ambient environment.

18. A wine bottle temperature control container according to claim 17, wherein said wicking medium is so configured as to absorb condensed liquid from said cooling system so as to provide for at least a portion of the condensed liquid to evaporate into the ambient environment.

19. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said housing comprises a backing wall having a front side and a back side, said front side defining a wall of said chamber, said back side being in communication the ambient environment, and said cooling system mounted to said backing wall, such that said cold side assembly is mounted to said front side and said hot side assembly is mounted to said back side.

20. A wine bottle temperature control container according to claim 19, wherein said housing further comprises a floor wall that houses a liquid drainage system, said liquid drainage system being in fluid communication with said control system so as to receive condensed liquid therefrom.

21. A wine bottle temperature control container according to claim 20, wherein said drainage system is in communication with the ambient environment via said back side of said backing wall so as to provide for at least a portion of the received condensed liquid to evaporate into the ambient environment.

22. A wine bottle temperature control container comprising:

a housing unit defining a storage chamber configured to receive a plurality of bottles in an upright position;

a cooling system mounted to said housing unit, said cooling system comprising a cold side assembly system in heat transfer communication with the inside of said storage chamber, and a hot side assembly system in heat transfer communication with the ambient environment;

a temperature modulator linked to said cooling system for modulating the temperature within said storage chamber;

wherein said housing comprises a translucent cover to allow viewing of upright bottles contained therein and wherein said translucent cover comprises a door for providing a full view of said storage chamber.

23. A wine bottle temperature control container according to claim 1, wherein said temperature modulator comprises thermoelectric modules.

* * * * *